US011952017B2

(12) United States Patent
Böge et al.

(10) Patent No.: US 11,952,017 B2
(45) Date of Patent: Apr. 9, 2024

(54) SANDING SYSTEM FOR A RAIL VEHICLE

(71) Applicant: Siemens Mobility GmbH, Munich (DE)

(72) Inventors: Ronny Böge, Olching (DE); Michel Maurer, Munich (DE); Wilfried Stelzle, Kleinberghofen (DE)

(73) Assignee: Siemens Mobility GmbH, Munich (DE)

( * ) Notice: Subject to any disclaimer, the term of this patent is extended or adjusted under 35 U.S.C. 154(b) by 0 days.

(21) Appl. No.: 18/257,635

(22) PCT Filed: Nov. 17, 2021

(86) PCT No.: PCT/EP2021/081976
§ 371 (c)(1),
(2) Date: Jun. 15, 2023

(87) PCT Pub. No.: WO2022/128294
PCT Pub. Date: Jun. 23, 2022

(65) Prior Publication Data

US 2024/0043046 A1 Feb. 8, 2024

(30) Foreign Application Priority Data

Dec. 15, 2020 (DE) ..... 10 2020 215 952.1

(51) Int. Cl.
*B61C 15/10* (2006.01)

(52) U.S. Cl.
CPC ..... *B61C 15/107* (2013.01); *B61C 15/102* (2013.01)

(58) Field of Classification Search
CPC ..... B61C 15/10–107; B60B 39/022; B60B 39/023; B60B 39/06; B60B 39/086; B61K 3/02; F16N 2270/20
(Continued)

(56) References Cited

U.S. PATENT DOCUMENTS 1,360,627 A * 11/1920 Dreisbach ..... B61C 15/102 291/24
1,781,637 A * 11/1930 Gilligan ..... B61C 15/102 291/24
(Continued)

FOREIGN PATENT DOCUMENTS

CN 107380176 A * 11/2017 ..... B61C 15/102
CN 107380176 A 11/2017
(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

The invention relates to a sanding system for a rail vehicle with a grit container, with a conveying device and with a feeding device. The grit container contains a grit. The grit passes from the grit container into the conveying device and from the conveying device into the feeding device. The feeding device is configured in such a way that the grit can be introduced in a targeted manner into a wheel region and/or into a rail region of the rail vehicle. The conveying device has a driven conveyor worm which rotates about a longitudinal axis and by way of which the grit passes from the grit container into a conveying chamber. Compressed air can be introduced into the conveying chamber, in order to transport the grit from the conveying chamber into the feeding device.

11 Claims, 2 Drawing Sheets

(58) Field of Classification Search
USPC ..... 291/33
See application file for complete search history.

(56) References Cited

U.S. PATENT DOCUMENTS

| | | | | | |
|---|---|---|---|---|---|
| 2,256,288 | A * | 9/1941 | McCune | ..... | B61H 11/005 291/33 |
| 2,342,895 | A * | 2/1944 | Saari | ..... | B61C 15/102 137/98 |
| 2,377,938 | A * | 6/1945 | Hoffman | ..... | B61C 15/102 291/11.1 |
| 2,529,751 | A * | 11/1950 | White | ..... | B61C 15/102 291/12 |
| 4,114,932 | A | 9/1978 | Freeberg | | |
| 2018/0072329 | A1* | 3/2018 | Krismanic | ..... | B61C 15/10 |

FOREIGN PATENT DOCUMENTS

| | | | | | |
|---|---|---|---|---|---|
| DE | 102012214643 | A1 | 2/2014 | | |
| DE | 202014004632 | U1 | 8/2014 | | |
| DE | 102017122860 | A1 | 4/2019 | | |
| EP | 0656292 | A1 * | 6/1995 | ..... | B61C 15/102 |
| GB | 328597 | A | 4/1930 | | |

* cited by examiner

SANDING SYSTEM FOR A RAIL VEHICLE

FIELD AND BACKGROUND OF THE INVENTION

The invention relates to a sanding system for a rail vehicle.

Rail vehicles generally suffer from the fact that, when the rails are wet or covered with leaves, they are able, only with difficulty, to apply or transfer their full drive or traction power to the rail.

To counter this problem, sanding systems are known which contain a grit (for example quartz sand with a predetermined grain size) and introduce it as required, and possibly with compressed-air assistance, into a wheel-rail gap in order to increase the traction power on the rail.

It is important here for the grit to be introduced into the wheel-rail gap as homogeneously but also as sparingly as possible in order, on the one hand, to optimize the traction power transmitted to the rail and, on the other hand, to use a limited supply of grit and a limited supply of compressed air in a time- and quantity-optimized manner.

Although sanding systems which require small amounts of compressed air can be realized with low outlay, they only allow an intermittent discharge of a quantity of grit. Here, the grit is applied to the rail at discrete points.

Also known are more elaborate sanding systems which combine mechanical metering of the grit with compressed-air delivery of the grit. These systems allow a stepwise or stepless and speed-dependent discharge of grit onto the rail, but have the disadvantage of relatively high compressed-air consumption.

A further disadvantage of such systems is that the grit is discharged in pulsed form. This disadvantageously results in a reduced transfer of the traction power to the rail.

It is therefore the object of the present invention to specify a sanding system for a rail vehicle that overcomes the aforementioned disadvantages and at the same time allows optimized or improved transfer of the traction power of the rail vehicle to the rail.

This object is achieved by the features as claimed. Advantageous developments are specified in the dependent claims.

SUMMARY OF THE INVENTION

The invention relates to a sanding system for a rail vehicle having a grit container, having a conveying device and having a feeding device. The grit container contains a grit and is connected to the conveying device such that the grit passes from the grit container into the conveying device. The conveying device is connected to the feeding device such that the grit passes from the conveying device into the feeding device. The feeding device is designed in such a way that the grit can be introduced in a targeted manner into a wheel region and/or into a rail region of the rail vehicle.

According to the invention, the conveying device comprises a driven conveying worm which rotates about a longitudinal axis and by means of which the grit passes from the grit container into a conveying chamber. Compressed air can be introduced into the conveying chamber in order to transport the grit from the conveying chamber into the feeding device.

In an advantageous development, the conveying device has an elongate worm chamber in which the conveying worm is arranged.

The worm chamber and/or the conveying worm are or is preferably oriented horizontally or with an upward or downward inclination from the horizontal plane in order to transport the grit within the conveying device in an optimized manner.

In an advantageous development, the conveying worm is connected to an electric motor which turns the conveying worm or sets it in rotation.

In an advantageous development, the electric motor can be steplessly controlled to control the rotational speed, with this preferably occurring by varying the operating voltage or the operating current of the electric motor.

Consequently, for a predetermined grain size of the grit, a delivery amount of the grit can be set by changing the rotational speed.

In an advantageous development, the conveying chamber is arranged between the conveying device and the feeding device, is configured to be hollow and into which compressed air can be introduced.

The grit, which is conveyed from an inlet zone of the conveying device into an outlet zone of the conveying device over the entire worm chamber, preferably falls vertically into the conveying chamber. The introduced compressed air acts on the grit at a lowest point of the conveying chamber, with the grit being transported into the feeding device with compressed-air assistance.

In an advantageous development, the conveying chamber is connected to a compressed-air nozzle in a lateral region.

In an advantageous development, the compressed air is controlled in such a way

- that, for an active conveying device, the compressed air catches the grit falling into the conveying chamber and transports it into the feeding device, or
- that, for an inactive conveying device, the compressed air is introduced via the conveying chamber into the feeding device in order to clean it or in order to dry it.

This compressed-air control reduces or prevents clumping of the grit in the feeding device or eliminates blockages or clogging there.

For this purpose, compressed air is preferably blown into the feeding device at fixed time intervals.

In a preferred development, the conveying worm is designed in such a way that the conveying device mechanically closes off the system upwardly during the cleaning or drying operation.

In an advantageous development, a transition from the conveying chamber to the feeding device is designed according to the Venturi principle, for example as a Venturi nozzle or as a de Laval nozzle, in order to additionally accelerate the mixture of grit and compressed air.

In an advantageous development, the worm chamber or the conveying device has at its lowest point an inspection opening for cleaning purposes.

This ensures easier access to the entire system for cleaning purposes. Relatively large contaminants (for example cigarette butts, leaves, etc.) in the grit can be readily removed via the inspection opening without having to dismantle the system components.

The inspection opening also allows a clean exchange of system components. In the present invention, the inspection opening allows targeted, clean removal of the grit, for example into a bucket which is arranged below the inspection opening. System components can then be dismantled in the thus resulting clean surroundings without having to carry out further complicated protection measures on surrounding components.

This does away with the problem which occurs in systems of conventional design according to the prior art: what happens there is that defective components are removed when the grit containers are full, with the result that grit runs in an uncoordinated manner over adjacent system components. As a result, sealing planes and supply lines are additionally contaminated and then have to be laboriously cleaned.

In an advantageous development, the feeding device is designed in such a way that the grit is introduced in a targeted manner into a wheel-rail gap of the rail vehicle.

In an advantageous development, the grit container has at its lowest point a flange with through-opening that is connected to a funnel-shaped flange with through-opening of the conveying device. The latter are formed in such a way that the grit passes directly into the conveying device or into the worm chamber exclusively under the action of gravity.

The sanding system according to the invention allows the grit to be discharged in a uniform and sparing manner.

The sanding system according to the invention is operated with an extremely low compressed-air consumption, and a required air quantity is reduced to a functional minimum.

The sanding system according to the invention advantageously combines two operating principles:

- a first operating principle which acts in a first subportion of the sanding system and in which grit is conveyed or transported via a mechanism, and
- a second operating principle which acts in a second subportion of the sanding system and in which the grit is transported via components of simple design with the aid of compressed air and is finally applied to the rail.

The combination of the two operating principles ensures a very accurate discharge of grit with at the same time a low use of resources (compressed air, grit).

The sanding system according to the invention reduces fine dust pollution of the environment. This is achieved by individual, speed-dependent delivery of the grit that is set via the rotational speed of the conveying worm.

Consequently, the grit consumption is reduced for the benefit of the environment and costs are saved for the customer.

In addition, hitherto necessary maintenance intervals of the sanding system are extended and necessary replenishments of the sanding system with grit are reduced.

BRIEF DESCRIPTION OF THE FIGURES

The present invention will be explained in more detail below by way of example on the basis of a drawing, in which.

DETAILED DESCRIPTION OF THE INVENTION

Figure 1:
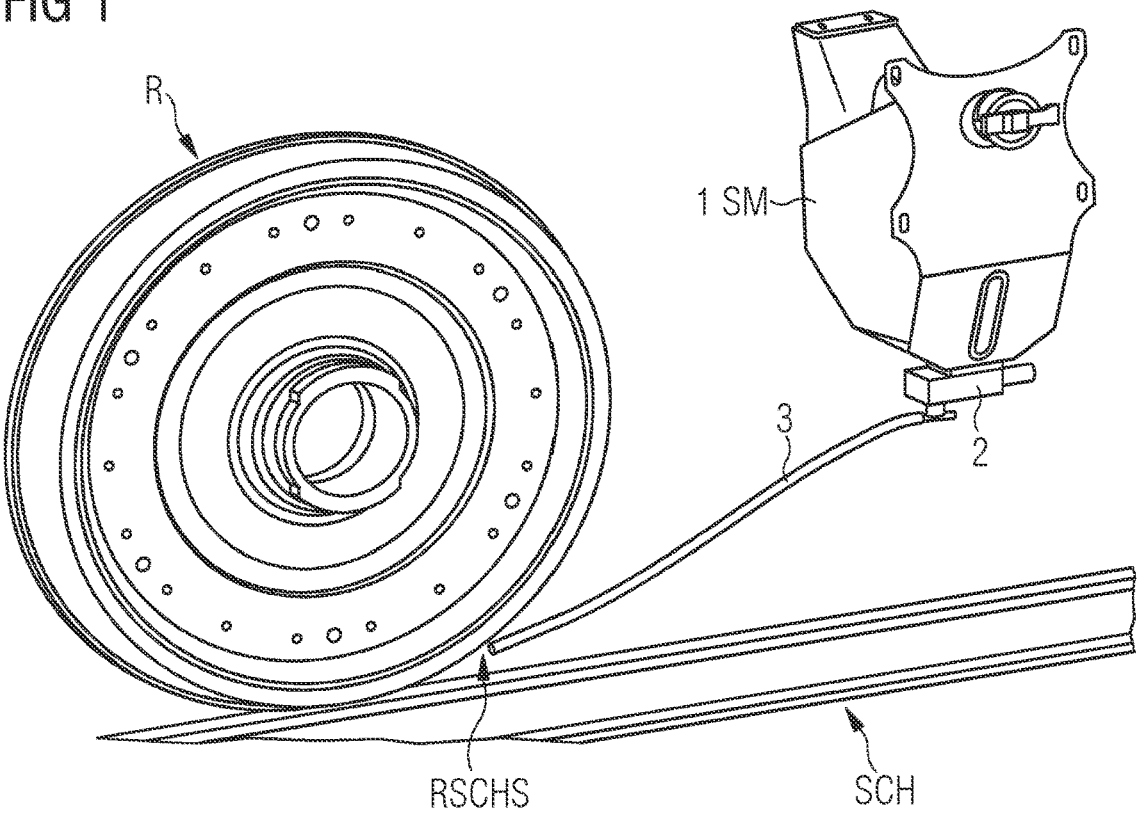
FIG. 1 shows the arrangement according to the invention in an overview.

FIG. 1 shows the arrangement according to the invention in an overview.

The sanding system for a rail vehicle has a grit container 1, a conveying device 2 and a feeding device 3.

The grit container 1 contains a grit SM and is connected to the conveying device 2 such that the grit SM passes from the grit container 1 into the conveying device 2.

The connection between the grit container 1 and the conveying device 2 is provided at the lowest point of the grit container 1.

The conveying device 2 is connected to the feeding device 3 such that the grit SM passes from the conveying device 2 into the feeding device 3.

The feeding device 3 is designed in such a way that the grit SM can be introduced in a targeted manner into a region of the wheel R and/or into a region of the rail SCH or into a wheel-rail gap RSCHS of the rail vehicle.

Figure 2:
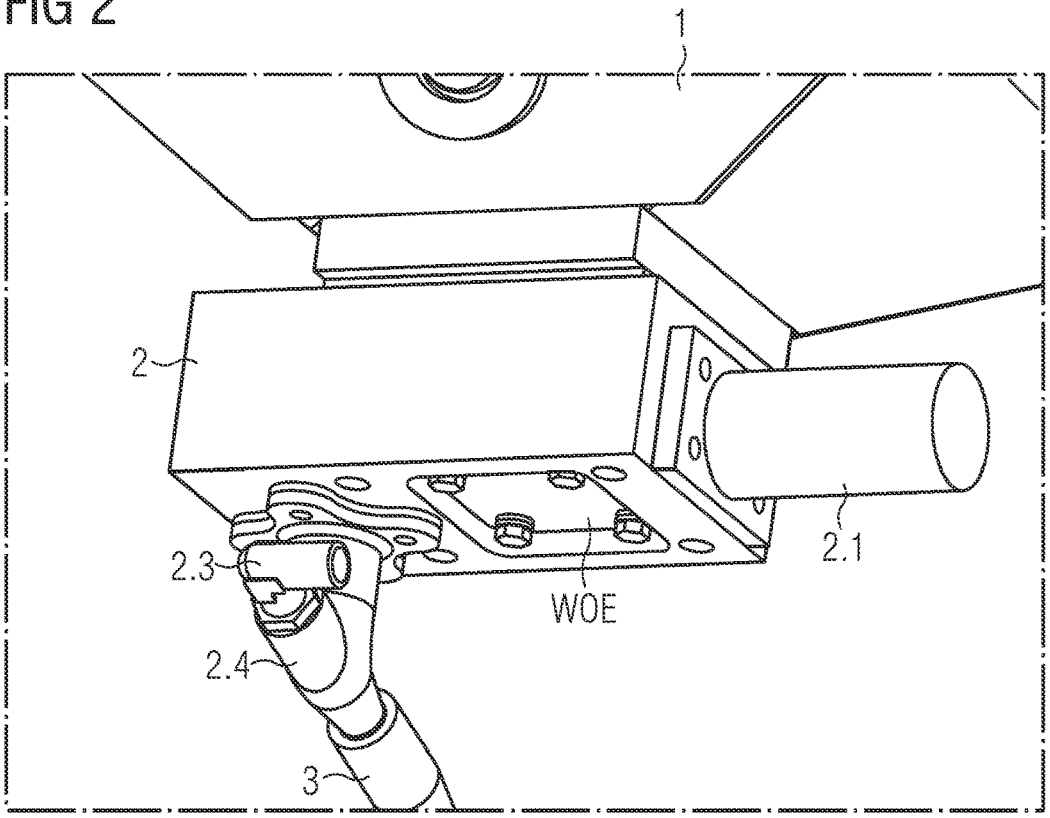
FIG. 2 to FIG. 4 shows details of the arrangement according to the invention with reference to FIG. 1.
Figure 3:
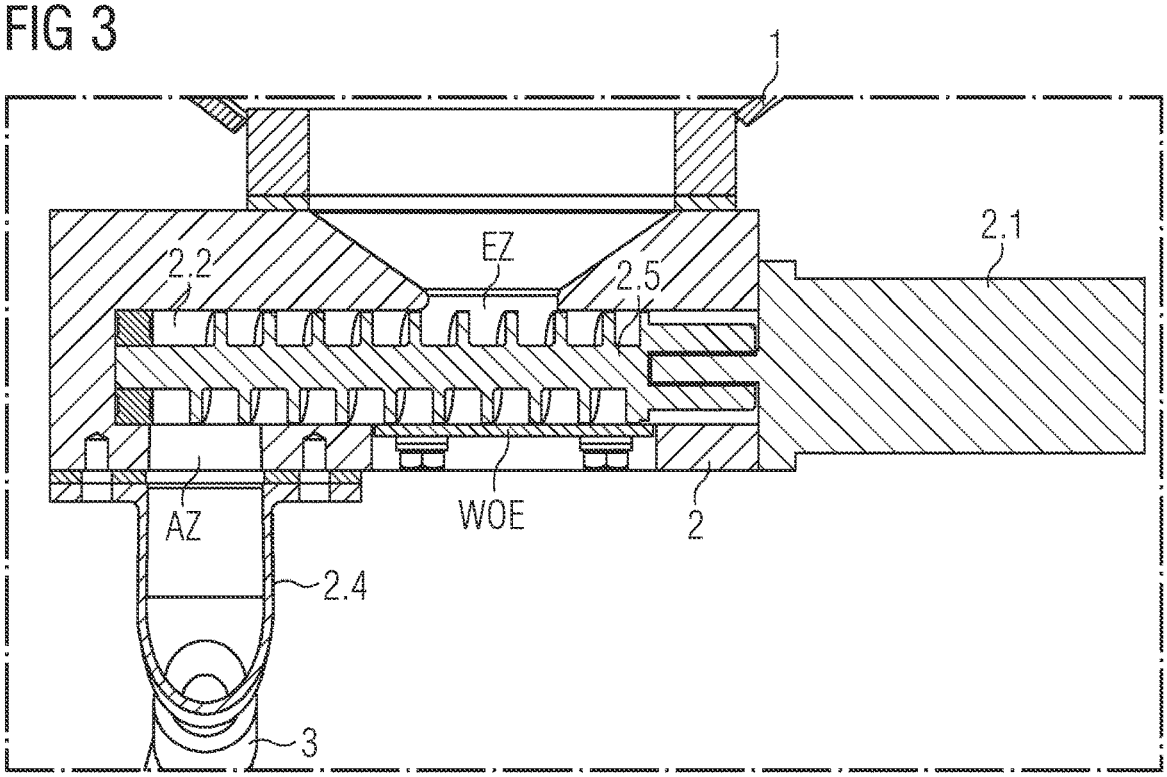

FIG. 2 and FIG. 3 show details of the conveying device 2 and of the feeding device 3.

The conveying device 2 comprises a driven conveying worm 2.5 which rotates about a longitudinal axis and by means of which the grit SM is transported from the grit container 1 into the feeding device 3.

The conveying device 2 has an elongate worm chamber 2.2 in which the conveying worm 2.5 is arranged. Here, the screw chamber 2.2 and the conveying worm 2.5 are oriented horizontally.

The conveying worm 2.5 is connected to an electric motor 2.1 which turns the conveying worm 2.5 or sets it in rotation.

The electric motor 2.1 can be controlled to control the rotational speed such that, for a predetermined grain size of the grit SM, a delivery amount of the grit SM can be set by changing the rotational speed.

The electric motor 2.1 rotates more slowly or more quickly by stepwise changes of an electrical voltage or current intensity, with the result that the quantity of the grit SM to be conveyed can be set very accurately.

The speed of rotation of the conveying worm 2.5 is thus changed or adapted depending on the grain size of the grit SM. A highly precise delivery amount is thus achieved.

A hollow conveying chamber 2.4 is arranged between the conveying device 2 and the feeding device 3 such that the grit SM, which is conveyed from an inlet zone EZ of the conveying device 2 into an outlet zone AZ of the conveying device 2 over the entire worm chamber 2.2, falls vertically into the conveying chamber 2.4 and reaches a lowest point of the conveying chamber 2.4 there.

A compressed-air feed 2.3 is provided on the conveying chamber 2.4. This compressed-air feed can be designed, for example, as a compressed-air hose in order to supply compressed air to the conveying chamber 2.4 via a controllable compressed-air nozzle 2.6.

The grit container 1 has at its lowest point a flange with through-opening that is connected to a flange with through-opening of the conveying device 2. The latter together form a funnel such that grit SM passes directly into the conveying device 2 or into the worm chamber 2.2 under the action of gravity.

Thus, as a result of gravity, the grit SM can fall or pass into the worm chamber 2.2 directly, that is to say without additional loosening elements, stirrers, etc.

Owing to the selected interface between the grit container 1 and conveying device 2, bridge formations of the grit are prevented in this region.

The conveying worm 2.5 further assists this effect in that, on account of the (stirring) movement carried out by it, a movement of the grit SM is assisted in the lower interface region.

With this arrangement, the grit is removed from the grit container 1 down to the last grain, with retention of old grit being avoided.

The conveying device 2 or the worm chamber 2.2 has at its lowest point an inspection opening WOE for cleaning purposes. This ensures easier access to the entire system for cleaning purposes. Relatively large contaminants (for example cigarette butts, leaves, etc.) in the grit SM can be readily removed via the inspection opening WOE without having to dismantle system components.

Figure 4:
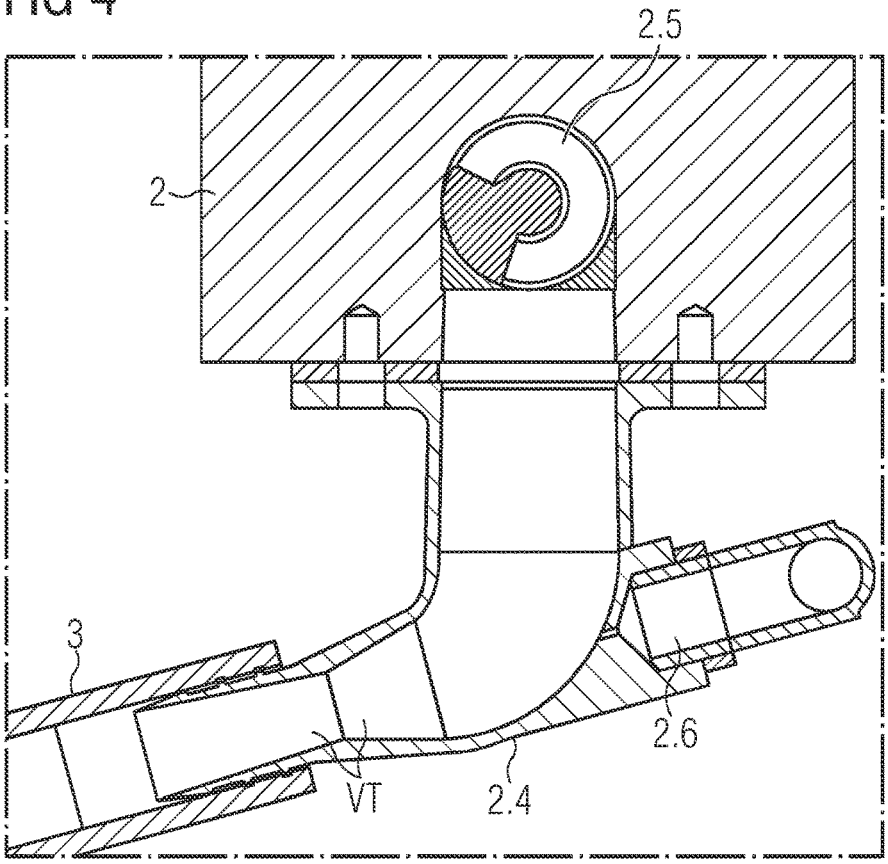

FIG. 4 shows details of the conveying chamber 2.4.

The conveying chamber 2.4 is connected to a compressed-air nozzle 2.6 in a lateral region. Said nozzle is controlled in such a way that, for an active conveying device 2 or for an active conveying worm 2.5, compressed air catches the grit SM falling into the conveying chamber 2.4 and transports it into the feeding device 3 with compressed-air assistance, or that, for an inactive conveying device 2 or for an inactive conveying worm 2.5, compressed air is introduced into the feeding device 3 via the conveying chamber 2.4 in order to clean it or in order to dry it.

A transition from the conveying chamber 2.4 to the feeding device 3 is preferably designed, as shown here, as a Venturi nozzle VT or as a de Laval nozzle.

The invention claimed is:

1. A sanding system for a rail vehicle, the sanding system comprising:

a grit container containing grit;

a conveying device connected to said grit container, wherein the grit passes from said grit container into said conveying device; and a feeding device connected to said conveying device, wherein the grit passes from said conveying device into said feeding device;

said feeding device being configured to feed the grit in a targeted manner toward at least one of a rail vehicle wheel or a rail;

said conveying device including a driven conveying worm configured to rotate about a longitudinal axis and conveying the grit from said grit container into a conveying chamber;

an electric motor being a steplessly speed-controlled drive connected for driving said conveying worm, said electric motor to be controlled for controlling a rotational speed:

to set, based on a predetermined grain size of the grit, a delivery amount of the grit by changing the rotational speed;

to set a speed of rotation of said conveying worm depending on the grain size of the grit in order to discharge the grit uniformly and sparingly; and a compressed air injection device including a compressed air nozzle for introducing compressed air at a lateral region into said conveying chamber, said compressed air injection device being configured:

in an active state of the conveying device, to transport the grit from said conveying chamber into said feeding device and, in an inactive state of the conveying device, to inject compressed air for at least one of cleaning or drying the feeding device.

2. The sanding system according to claim 1, wherein said conveying device comprises an elongate worm chamber in which said conveying worm is disposed, and wherein at least one of said worm chamber or said conveying worm are horizontally oriented or have an upward or downward inclination relative to a horizontal plane.

3. The sanding system according to claim 1, wherein said conveying chamber has a hollow configuration and is disposed between said conveying device and said feeding device such that the grit, which is conveyed from an inlet zone of said conveying device into an outlet zone of said conveying device over the entire said worm chamber, falls vertically into said conveying chamber.

4. The sanding system according to claim 3, wherein said compressed air injection device comprises a compressed-air nozzle connected to said conveying chamber.

5. The sanding system according to claim 4, wherein said compressed-air nozzle is arranged in a lateral region of said conveying chamber.

6. The sanding system according to claim 4, wherein said compressed-air nozzle is controlled as follows:

for an active conveying device, to cause compressed air to catch the grit falling into said conveying chamber and to transport the grit into said feeding device; or for an inactive conveying device, to cause the compressed air that is introduced into said feeding device via said conveying chamber to clean or dry said feeding device.

7. The sanding system according to claim 1, wherein a transition from said conveying chamber to said feeding device is configured as a Venturi nozzle or as a de Laval nozzle.

8. The sanding system according to claim 1, wherein said conveying device or said worm chamber is formed with an inspection opening for at least one of cleaning or emptying grit therefrom.

9. The sanding system according to claim 8, wherein said inspection opening is formed at a lowest point of said conveying device or said worm chamber.

10. The sanding system according to claim 1, wherein said feeding device is configured to introduce the grit in a targeted manner into a wheel-rail nip of the rail vehicle.

11. The sanding system according to claim 1, wherein said grit container has a flange with through-opening at a lowest point thereof that is connected to a flange with through-opening of said conveying device, and wherein said openings are formed to enable the grit to pass directly by gravity into said conveying device or into said worm chamber.

* * * * *